United States Patent [19]

Hazelbaker

[11] Patent Number: 5,018,222

[45] Date of Patent: May 28, 1991

[54] PROTECTIVE SHIELD

[76] Inventor: Loren A. Hazelbaker, 104 Tunnel Rd., Milton, Fla. 32571

[21] Appl. No.: 587,772

[22] Filed: Sep. 24, 1990

Related U.S. Application Data

[63] Continuation-in-part of Ser. No. 500,959, Mar. 29, 1990.

[51] Int. Cl.[5] ..... A41B 13/10

[52] U.S. Cl. ..... 2/49 A; 2/46; 2/104

[58] Field of Search ..... 2/46, 48, 49 R, 49 A, 2/50, 51, 52, 104; 224/270, 257, 207, 202

[56] References Cited

U.S. PATENT DOCUMENTS

| | | | |
|---|---|---|---|
| 1,108,557 | 8/1914 | Duddley | 2/49 R |
| 1,516,590 | 11/1924 | Dorsey | 2/50 |
| 1,592,283 | 7/1926 | McKenzie | 2/49 R |
| 1,979,632 | 11/1934 | McClure | 2/49 A |
| 2,199,334 | 4/1940 | Ferry | 2/50 |
| 2,265,690 | 12/1941 | Fiedler | 2/49 A |
| 2,289,945 | 7/1942 | Sadsack | 224/201 X |
| 2,367,383 | 1/1945 | Tiscornia | 2/49 R |
| 2,446,689 | 8/1948 | Brose et al. | 2/49 R |
| 2,558,414 | 6/1951 | Blackman | 2/49 A |
| 2,672,614 | 3/1954 | Zimmerman et al. | 2/49 R |
| 2,697,222 | 12/1954 | Reid | 2/49 R |
| 2,709,544 | 5/1955 | Barringer | 224/202 X |
| 2,717,389 | 9/1955 | Gribble et al. | 2/50 |
| 2,984,840 | 5/1961 | Parco | 2/50 |
| 3,009,613 | 11/1961 | Noland | 224/270 X |
| 3,945,048 | 3/1976 | Shearer | 2/49 R |
| 4,114,199 | 9/1978 | Malan | 2/49 A |
| 4,715,293 | 12/1987 | Cobbs | 224/265 X |
| 4,860,381 | 8/1989 | Bartley | 2/49 A |
| 4,887,315 | 12/1989 | Bezdek | 2/49 A |

FOREIGN PATENT DOCUMENTS

| | | | |
|---|---|---|---|
| 2178298 | 2/1987 | United Kingdom | 2/49 R |

*Primary Examiner*—Werner H. Schroeder
*Assistant Examiner*—Jeanette E. Chapman
*Attorney, Agent, or Firm*—Kelly O. Corley

[57] ABSTRACT

A protective device for use when changing the diaper of a male infant. The device comprises a transparent shield suspended between the user's face and the infant, the shield being supported by straps or the like engaging the user's neck or shoulders.

7 Claims, 1 Drawing Sheet

PROTECTIVE SHIELD

This is a continuation-in-part of copending application Ser. No. 500,959, filed 3/29/90 now abandoned.

The invention relates to the art of protective shields, and more particularly to such shields adapted for use while changing the diaper of a male human infant.

When changing the diaper of a male infant, the problem occasionally arises that the infant empties his bladder after the soiled diaper has been removed and before a fresh one can be installed. When this occurs, the resulting stream is propelled in a generally upwardly direction, with the possibility of striking the face of the person changing the diaper. While it is possible to manipulate the diapers such that one is always between the infant and the person's face, this is not always easy if the infant is squirming.

Face shields traditionally have been mounted on the head, such as welders' face shields and motorcycle helmets. These have the difficulty that their use would disarrange many women's coiffures.

According to the invention, these and other difficulties with prior practices are avoided by provision of the novel shield disclosed herein.

According to a first major aspect of the invention, there is provided a protective device for use by a person changing diapers of a male infant, the person having a body comprising a neck, a face, a trapezius region, and a torso, the device comprising a substantially transparent shield having a major central region, a proximal end edge region, a distal end edge region, and first and second lateral edge regions, the shield having a center of gravity intermediate the proximal and distal end edge regions, and suspension means for suspending the shield from the trapezius region between the infant and the face.

According to another aspect of the invention, the suspension means supports the shield with the proximal end edge region resting against the torso.

According to another aspect of the invention, the suspension means comprises a first flexible strap engaging the neck.

According to another aspect of the invention, the suspension means further comprises means for connecting the first strap to a region on the shield nearer to the proximal end edge region than the center of gravity.

According to another aspect of the invention, the suspension means further comprises a second strap supported by the neck and connecting to a second region on the shield farther from the proximal end edge region than the center of gravity.

According to another aspect of the invention, the shield is substantially planar.

According to another aspect of the invention, at least one edge region of the shield is bent downwardly and inwardly to terminate in an upwardly directed free edge spaced from the major central region.

Figure 1:
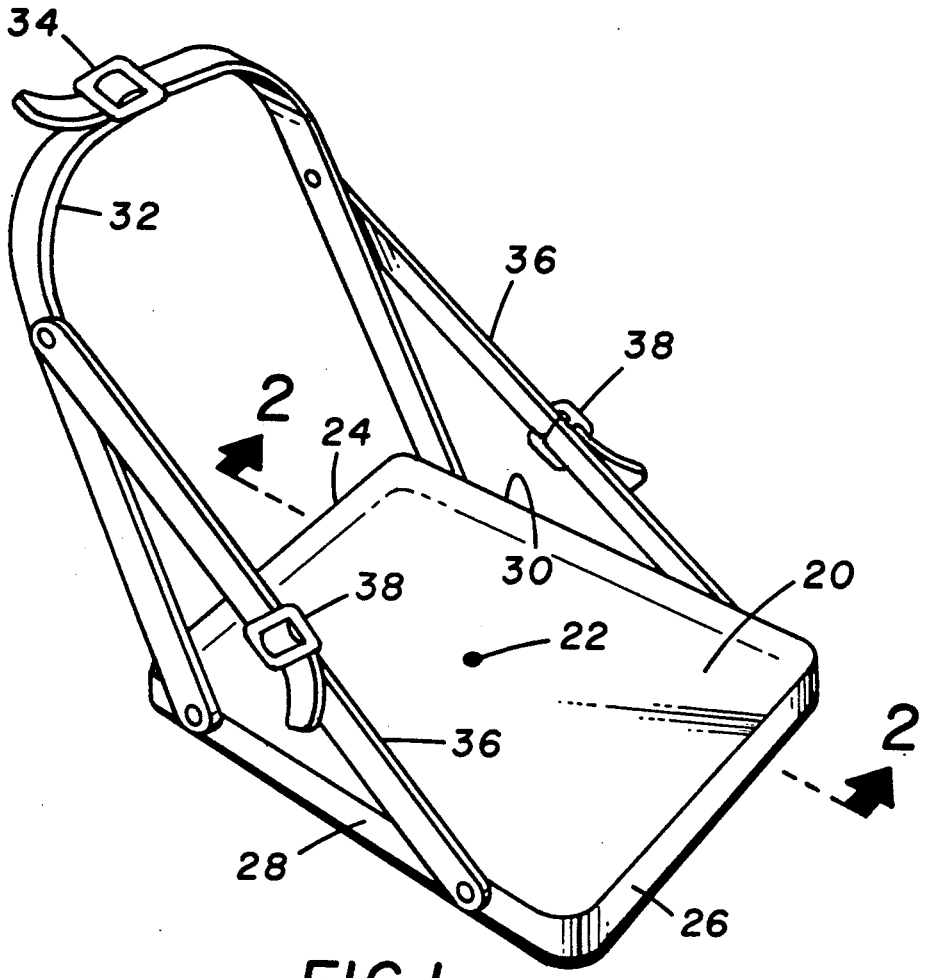
Figure 2:
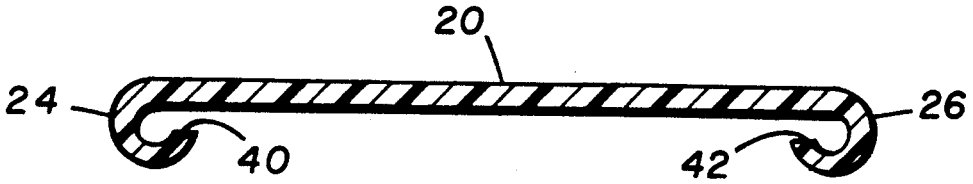

Other aspects will in part be disclosed hereinafter and will in part be apparent from the following detailed description taken together with the accompanying drawings, wherein:

FIG. 1 is a perspective view of the preferred embodiment of the invention; and FIG. 2 is a sectional view of a modified embodiment, taken along line 2—2 in FIG. 1.

As illustrated in FIG. 1, the protective device comprises substantially transparent shield 20 which is to be disposed between the infant and the face of the person changing the diaper. Shield 20 has a center of gravity 22 located in the major central region of shield 20, a proximal edge region 24, a distal edge region 26, and lateral edge regions 28 and 30.

Also provided are suspension means for suspending shield 20 from the trapezius region, that is, from the region overlying the trapezius muscle, which is a broad, flat, triangular muscle, placed immediately beneath the skin and fascia, and covering the upper and back part of the neck and shoulders. Advantageously, shield 20 is suspended from the neck portion of the trapezius region of the user between the infant and the user's face. In the preferred embodiment illustrated, the suspension means comprises flexible strap 32 for engaging the neck portion of the trapezius region of the user, although it could comprise straps or other supporting means engaging the shoulder portion of the trapezius region of the user. Adjustable buckle 34 permits adjusting the length of strap 32 as desired. The lower ends of strap 32 are attached to shield 20, as by riveting, at a region nearer proximal edge region 24 than center of gravity 22.

Second straps 36 have their lower ends attached to shield 20 at points further from proximal edge region 24 than center of gravity 22, and their upper ends arranged to be supported by the user's neck. As illustrated, this may be accomplished by riveting or otherwise attaching these upper ends to strap 32 near the region where strap 32 contacts the user's neck. Alternatively, straps 36 may be replaced by a single strap similar to strap 32 and similarly engaging the user's neck. Buckles 38 provide for adjustment of straps 36.

In the preferred embodiment, shield 20 is planar, and preferably is formed from a sheet of transparent plastic.

FIG. 2 illustrates a variant wherein one or more of the edge regions are bent downwardly and inwardly, terminating in upwardly directed free edges 40 and 42 spaced from the major central region of the shield, providing channels for catching the fluid.

In use, strap 32 is placed around the user's neck, with proximal end edge region 24 resting against the user's torso. Buckles 34 and 38 are adjusted such that shield 20 is supported between the infant and the user's face. This leaves both the user's hands free for use in changing the diaper, and does not disturb the user's coiffure.

I claim:

1. A protective device for use by a person changing diapers of a male infant, said person having a body comprising a head, a face, a trapezius region, and a torso, said device comprising:

a. a substantially transparent shield having a major central region, a proximal end edge region, a distal end edge region, and first and second lateral edge regions, said shield having a center of gravity intermediate said proximal and distal end edge regions; and b. suspension means for suspending said shield from said trapezius region whereby said shield is supported between said infant and said face.

2. The protective device defined in claim 1, wherein said suspension means supports said shield with said proximal end edge region resting against said torso.

3. The protective device defined in claim 2, wherein said suspension means comprises a first flexible strap engaging said neck.

4. The protective device defined in claim 3, wherein said suspension means further comprises means for connecting said first strap to a region on said shield nearer to said proximal end edge region than said center of gravity.

5. The protective device defined in claim 4, wherein said suspension means further comprises a second strap supported by said neck and connecting to a second region on said shield farther from said proximal end edge region than said center of gravity.

6. The protective device defined in claim 1, wherein said shield is substantially planar.

7. The protective device defined in claim 1, wherein at least one edge region of said shield is bent downwardly and inwardly to terminate in an upwardly directed free edge spaced from said major central region.

* * * * *